US005943875A

United States Patent [19]

Hymes

[11] Patent Number: 5,943,875

[45] Date of Patent: Aug. 31, 1999

[54] SELF-COOLING FLUID CONTAINER WITH NESTED REFRIGERANT AND FLUID CHAMBERS

[75] Inventor: James Hymes, Lakewood, Colo.

[73] Assignee: Envirochill International, Ltd., Bridgetown, Barbados

[21] Appl. No.: 08/986,740

[22] Filed: Dec. 8, 1997

[51] Int. Cl.[6] ..... F25D 3/10

[52] U.S. Cl. ..... 62/294; 62/457.2

[58] Field of Search ..... 62/294, 457.2, 62/293, 92, 457

[56] References Cited

U.S. PATENT DOCUMENTS

| | | | |
|---|---|---|---|
| 3,373,581 | 3/1968 | Strader | 62/294 |
| 3,460,555 | 8/1969 | Puster | 137/12 |
| 3,696,633 | 10/1972 | Mills | 62/294 |
| 3,726,106 | 4/1973 | Jaeger | 62/294 |
| 4,584,848 | 4/1986 | Barnett | 62/294 |
| 4,802,343 | 2/1989 | Rudick et al. | 62/294 |
| 5,214,933 | 6/1993 | Aitchison et al. | 62/294 |
| 5,555,741 | 9/1996 | Oakley | 62/294 |
| 5,609,038 | 3/1997 | Halimi | 62/294 |

FOREIGN PATENT DOCUMENTS 513015 10/1920 France .

*Primary Examiner*—Henry Bennett
*Assistant Examiner*—Melvin Jones
*Attorney, Agent, or Firm*—Lappin & Kusmer LLP

[57] ABSTRACT

A self-cooling fluid container for beverages includes a beverage chamber and a refrigerant chamber in a nested configuration. Release of the refrigerant effects cooling of the beverage as a result of conductive heat transfer between the expanding refrigerant and the beverage chamber. The refrigerant chamber is wholly self-contained and nests snugly within a recess formed in the beverage chamber, thereby providing enhanced wall thickness and strength for containing a pressurized refrigerant, as well as enhanced heat transfer between the beverage chamber and the refrigerant chamber.

13 Claims, 2 Drawing Sheets

SELF-COOLING FLUID CONTAINER WITH NESTED REFRIGERANT AND FLUID CHAMBERS

FIELD OF THE INVENTION

The invention relates to improvements in self-cooling fluid containers, such as beverage containers.

BACKGROUND OF THE INVENTION

Self-cooling fluid containers are known to include, generally, a first chamber which contains a beverage to be cooled, a second refrigerant-containing chamber in thermal contact with the first chamber, a refrigerant dispersal assembly, including a third chamber which provides a volume for the refrigerant to expand into upon its release from the second chamber, and cooling activation means for establishing a fluid path between the refrigerant region to the dispersal region. Upon release of the refrigerant from the second chamber, the fluid in the first chamber is adiabatically cooled as a result of thermal contact between the refrigerant in the dispersal region and the fluid in the beverage chamber.

U.S. Pat. No. 5,214,933 to Aitchison et al. and U.S. Pat. No. 5,555,741 to Oakley, each assigned to the assignee of the present invention and hereby incorporated by reference into this application, disclose self-cooling fluid containers.

The Aitchison et al. patent discloses a capsule-type refrigerant chamber which extends into the fluid region of the beverage container. This design provides substantial heat transfer surface area between the fluid to be cooled and the refrigerant capsule. However, the possibility of leakage of the refrigerant into the fluid container, although highly unlikely, must be prevented.

The Oakley patent discloses a refrigerant chamber which is integral with the base of the beverage-containing chamber. Such an integrated design eliminates the need to separately manufacture, store and assemble multiple components. However, the walls of the integral capsule must be sufficiently thick to contain the pressurized refrigerant safely, thus increasing the cost of the container. Also, the integrated design requires that the refrigerant, which is relatively expensive, be introduced into the container during the manufacturing process prior to pasteurization and final quality control checks. If a container is found to be defective, it must be discarded from the production line, and the refrigerant charged thereinto must be either discarded or retrieved, at considerable expense.

French Patent No. 513,015 to Sterné discloses a beverage bottle or other fluid container which includes a hermetically sealed chamber containing chemicals which mix and react to effect heating or cooling of a fluid in contact with the chamber. The hermetically sealed chamber appears to be a generally cylindrical independent structure within a recess of a similar shape in the fluid container. The contents of the hermetically sealed chamber remain inside the chamber, even after they have combined to initiate the chemical reaction. Leakage of the chemicals into the fluid chamber is thus a potential hazard. In addition, the chamber is not removable from the fluid container and must therefore be manufactured with the container. Moreover, the sealed chamber cannot be reused after the chemical reaction has occurred. Disposal of the chamber may be problematic, depending on the integrity of the chamber and the nature of the chemicals therein. In addition, the chamber is not designed to withstand the storage pressures characteristic of liquid refrigerants and other pressurized substances.

Accordingly, it would be an advancement in the art of self-cooling fluid containers to provide a self-cooling fluid container having a refrigerant chamber that is entirely separate and removable from the beverage-containing chamber.

SUMMARY OF THE INVENTION

FIG. 1 illustrates the self-cooling beverage container of the present invention, which is advantageously configured to be substantially the same size and shape as a conventional beverage container, such as a soft drink can. The beverage container of the present invention is generally similar to that disclosed in the Aitchison et al. and Oakley patents, with the additional features of a wholly separable and reusable refrigerant chamber which nests snugly within a recess formed in the beverage chamber, and a cooling activation element which is disposed within the dome-shaped cavity at the bottom of the container.

A self-cooling container for fluids typically includes a first chamber having walls for defining a fluid region interior thereto, a second chamber having walls for defining a refrigerant region interior thereto, a refrigerant dispersal assembly having means for defining a dispersal region adjacent to the first and second chambers, and a cooling activation element for selectively forming a fluidic path from the refrigerant region of the second chamber to the dispersal region. The dispersal region includes a first portion adjacent to the refrigerant region and separated therefrom by a coupling portion of the walls of the refrigerant region, and a second portion adjacent to the fluid region and separated therefrom by a coupling portion of the walls of the fluid region. The dispersal region and the fluid region are thermally coupled through the coupling portion of the walls of said fluid region. The dispersal region is substantially closed and is vented to regions exterior to the container. The fluidic path for the refrigerant is established through the coupling portion of the walls of the refrigerant region.

According to the invention, the first chamber includes a recessed portion extending from a wall of the first chamber at least partially into the fluid region of the first chamber. The second chamber is adapted to engage with and fit snugly within the recessed portion of the first chamber in a nested configuration and is further adapted for removal from and replacement into the recessed portion of the first chamber.

The refrigerant chamber is adapted to contain and release a pressurizable material, such as a liquid refrigerant. The refrigerant chamber preferably comprises a capsule having at least one port through which the pressurizable material can be introduced and released. In a preferred embodiment, the refrigerant capsule is adapted for reuse after the pressurizable material has been released from it.

The cooling activation element is selectively engageable with the refrigerant chamber in the dispersal region to open the port in the refrigerant capsule to release the refrigerant therefrom.

The recessed portion of the first chamber preferably extends along a principal axis of the first chamber and the container. The refrigerant chamber and the recessed portion of the beverage chamber are of substantially the same size and shape so that the respective walls of the respective chambers nest together and function as a single-walled structure to contain the pressurized refrigerant. In a preferred embodiment, the walls of the refrigerant capsule and the recessed portion of the first chamber are slightly sloped at a nominal angle from the principal axis to facilitate insertion and removal of the capsule from the recess.

In another preferred embodiment, the region between the refrigerant capsule and the recessed portion of the first chamber is filled with a thermally conductive material to enhance heat transfer between the refrigerant and the beverage.

These and other features of the invention will be more fully appreciated with reference to the following detailed description which is to be read in conjunction with the attached drawings.

BRIEF DESCRIPTION OF THE DRAWINGS

The invention is further described by the following description and figures, in which.

DETAILED DESCRIPTION OF THE PREFERRED EMBODIMENT

Figure 1:
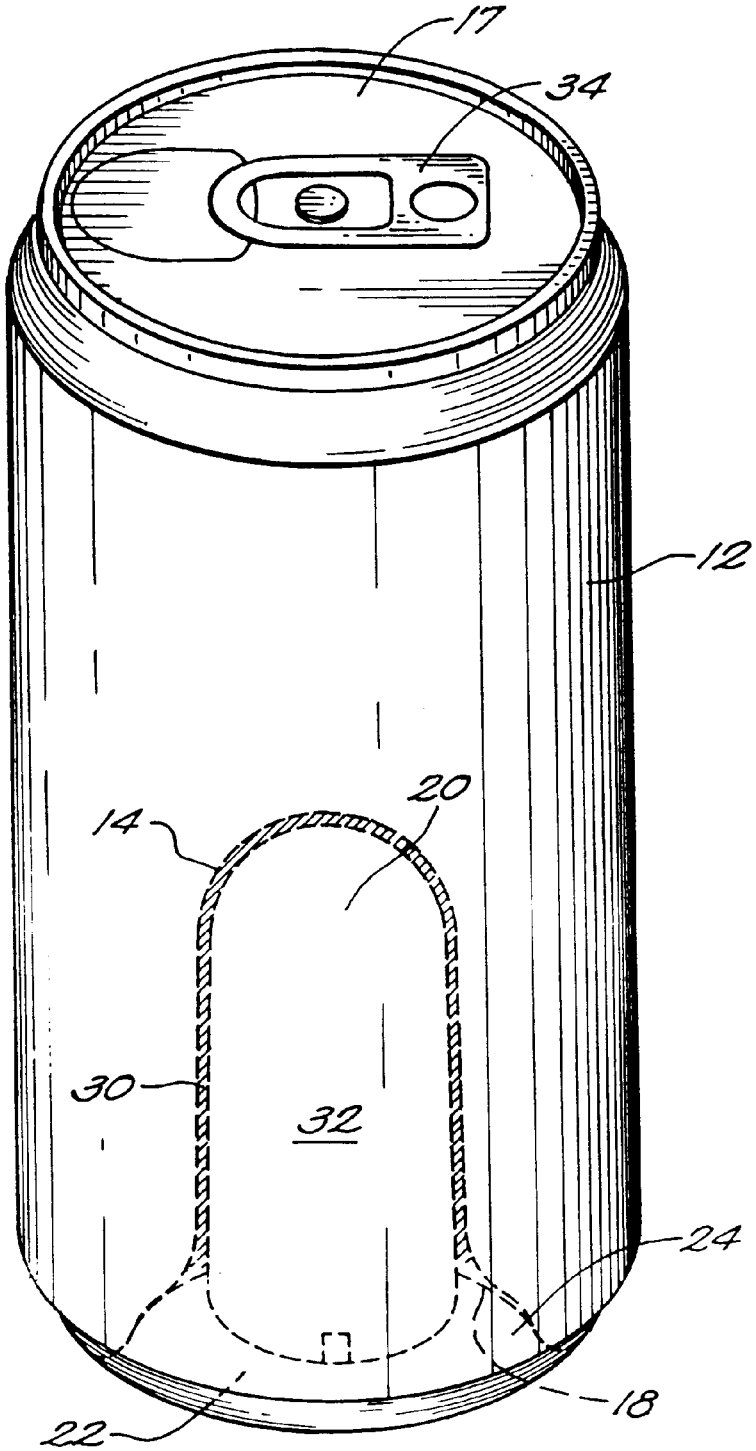
FIG. 1 is a perspective view of a self-cooling beverage container according to the present invention.

FIG. 1 shows a self-cooling container 10 for beverages such as, for example, juices, carbonated soft drinks, beer and the like. The container has a conventional opening tab on its upper end wall and conforms generally to conventional exterior dimensions and shape of such containers. Each structural component of the invention is of a composition preferably selected from aluminum, steel, aluminum and steel or other metal or metal alloy, plastic or any other material of sufficient strength, heat conductivity and recyclability.

Figure 2:
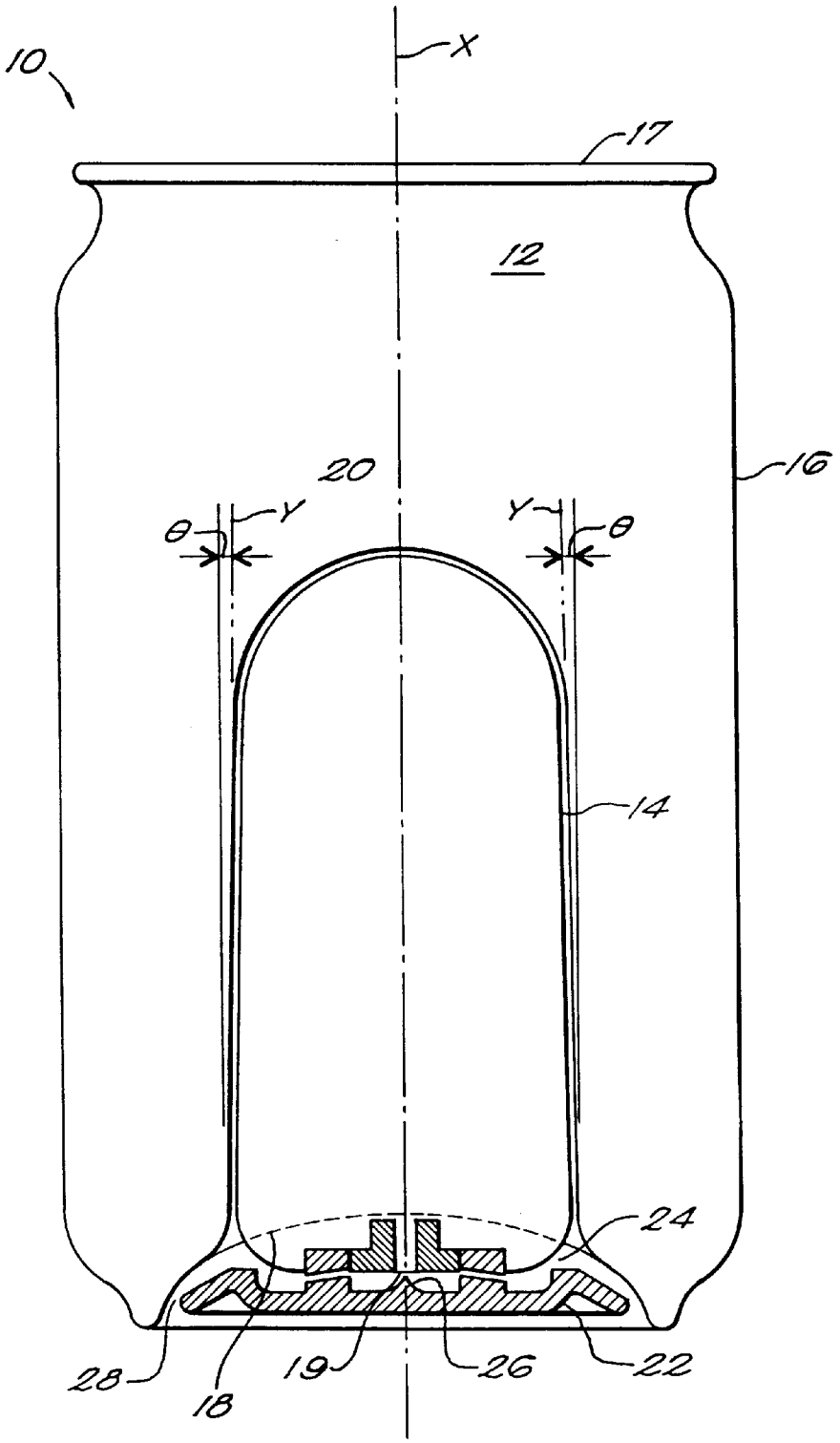
FIG. 2 is a sectional view of a the self-cooling beverage container of FIG. 1.

As shown more clearly in FIG. 2, the container 10 of the present invention is divided into two chambers, including an outer chamber defining a fluid vessel 12, typically for containing a beverage, and an inner chamber defining a refrigerant capsule 14.

The beverage vessel 12 is defined by cylindrical side wall 16, generally disc-like top wall 17, an annular bottom wall 18 which has a domed shape, and a recessed portion 20 of the first chamber, which extends preferably from the base wall 18 at least partially into the fluid region of the first chamber. The recessed portion 20 is preferably disposed substantially concentrically within the beverage vessel and coaxial with the principal axis X of the vessel.

The refrigerant capsule 14 is preferably generally cylindrical with rounded ends to provide sufficient strength to contain pressurized materials, such as liquid refrigerants. At its lower end the refrigerant capsule 14 includes a port 19 through which the refrigerant can be introduced and also released. The port can be, for example, a resealable membrane which can be penetrated with a piercing member, or a valve which is selectively activatable to release the contents of the capsule.

The refrigerant capsule is adapted to fit snugly within the recessed portion 20, as shown most clearly in FIG. 2, so as to provide maximum contact, and thus maximum heat transfer, between the capsule and the beverage container.

The walls of the recessed portion 20 and the capsule 14 are preferably sloped at a nominal angle θ from a vertical axis Y parallel to the principal axis X so as to facilitate the insertion and removal of the capsule from the recess. This configuration is often employed in stackable items, such as paper cups and the like. In a preferred embodiment, the angle θ is at least approximately 1° from a nominally vertical axis Y.

A cooling activation element 22 is disposed beneath the dome-shaped bottom 18 of the container. As detailed more fully below, the cooling activation element 22 is selectively engageable with a lower portion of the capsule 14 to open the port 19 of the capsule in order to release the refrigerant therefrom and initiate cooling of the contents of the fluid container 12.

In a preferred embodiment, the cooling activation element 22 is in threaded engagement with a corresponding threaded portion at the bottom of the refrigerant capsule 14. In the embodiment shown in FIG. 1, a piercing element 26 is substantially aligned with the port 19 of the refrigerant capsule. Rotation of the cooling activation element 22 toward the refrigerant capsule causes the piercing element 26 to penetrate the port and allow the contents of the capsule to be released through the port into a dispersal region 24 defined between the cooling activation element 22 and the bottom portions of the fluid container and the refrigerant capsule. In an alternative embodiment, the cooling activation element can be selectively engageable with the refrigerant capsule by pushing it up towards, and into contact with, the refrigerant capsule and allowing the natural springing action of the container bottom to return the cooling activation element to its nominal position after the port 19 has been opened to release the refrigerant.

The dispersal region 24 occupies a substantial portion of the volume beneath the dome-shaped bottom 18 of the fluid container and is configured to permit expansion and vaporization of the pressurized refrigerant upon its release from the capsule. In a preferred embodiment, the dispersal region 24 is in substantial thermal contact with the fluid container 12 so as to effect heat transfer between the expanding refrigerant and the beverage inside the container 12. The dispersal region 24 is substantially closed but includes one or more vents 28 to the exterior of the container for venting the vaporized refrigerant to the atmosphere after it has reached substantially ambient temperature.

The refrigerant capsule 14 is a substantially self-contained unit which can be inserted into, and removed from, the recessed portion 20 of the beverage container as desired, such as during manufacture or recycling of the beverage container.

Both the refrigerant capsule 14 and the recess 20 of the beverage container are preferably continuous structures manufactured without a seam. A seamless configuration permits the nesting chambers 14, 20 to form a snug-fitting double wall which is optimized for strength, as well as heat transfer therethrough. As detailed more fully below, an advantage of seamless structures for the beverage and refrigerant chambers is the elimination of the risk of a chemical reaction between the beverage and an unpassivated metal surface within the container.

The refrigerant capsule 14 is designed to nest within, and thus be substantially contiguous with, the walls of the recessed portion 20 of the beverage chamber 12 when the capsule is installed therein. The snug fit of the refrigerant capsule in the recessed portion of the beverage container substantially minimizes the extent of any gap or insulating space between the chambers, thereby providing maximum physical contact between the nested chambers. For enhanced heat transfer between the chambers, the region between them can be filled with a thermally conductive material 30, such as a thermally conductive epoxy or lubricant.

The capsule 14 includes an interior refrigerant region 32 which is adapted to contain a predetermined quantity of a refrigerant, preferably under pressure and in liquid form, such as hydrofluorocarbons (HFCs), carbon dioxide or other appropriate liquid refrigerants.

The fluid region, defined by the interior walls of the beverage vessel, contains the beverage to be cooled and is accessible to the consumer via a conventional die-cut pull tab device 34.

The dispersal region 24 between the cooling activation element 22 and the bottom of the beverage chamber and refrigerant capsule, is exposed to normal atmospheric pressure through venting pores 28 in the bottom of the beverage chamber.

In the operation of cooling a beverage within the container according to a preferred embodiment of the present invention, the cooling activation element 22 is rotated toward the top of the container in order to permit the piercing element to penetrate the port 19 of the refrigerant capsule 14. The refrigerant, upon release from the capsule and exposure to normal atmospheric pressure, rapidly evaporates and expands through the port into the dispersal region 24, where it decelerates and absorbs heat. The refrigerant capsule 14 and the dome-shaped bottom 18 of the beverage vessel 12 become cooled by conduction as a result of the cooling effect of evaporation and the adiabatic expansion of the refrigerant vapor. The beverage in the vessel is accordingly cooled by thermal conduction.

The rate that the refrigerant vapor is vented regulates the efficiency of the cooling and is determined in part by the diameter of port 19, the volume of the dispersal region 24, the surface area enclosing the dispersal region, and the size of the venting pores 28.

Several advantages of a nested configuration of the refrigerant chamber within a recessed portion of the beverage vessel can be realized. First, a separate refrigerant chamber can be manufactured, filled and stored independently from the beverage-containing chamber, thereby providing flexibility and an economic advantage. Second, a separate refrigerant chamber can be introduced into a finally inspected and approved and filled beverage container, and/or after the beverage has been pasteurized in the container, if necessary, thereby ensuring that refrigerant is not charged into containers which are not ultimately consumed. Third, a separate refrigerant chamber can also be reused in a new beverage container, which may also lower the unit cost of the container. Fourth, the refrigerant and beverage chambers, if independent, can be made of dissimilar materials. The preferred materials for a beverage chamber include, for example, aluminum and steel, whereas a preferred material for the refrigerant chamber may include, for example, a thermally conductive plastic. The use of a plastic for the refrigerant chamber permits the chamber to be made by a relatively inexpensive injection molding process instead of traditional manufacturing processes for metals, such as drawing and ironing and percussion extrusion. Sixth, the use of two separate chambers which nest to create a double-walled structure is advantageous for cost-effective containment of pressurized refrigerants. The combined strength of two relatively thin contiguous walls is likely to be at least as strong as a thicker, and thus more expensive, single-walled structure. Seventh, enhanced heat transfer potential between the beverage chamber and the refrigerant chamber is a result of their contiguity and the absence of any insulating gap between them, especially if the space between them is filled with a thermally conductive material. The snugly fitted walls of the two chambers behave thermally and structurally as a single wall. Eighth, the seamless structure of the beverage and refrigerant chambers eliminates the possibility that the beverage within the container will react chemically with any portion of the beverage container, such as unpassivated metal at an internal seam of the container. As the beverage in the container is likely to be relatively corrosive, any chemical reaction between an unprotected or unpassivated internal surface of the container and the beverage may adversely affect the taste or quality of the beverage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description. All changes that come within the meaning and range of the equivalency of the claims are therefore intended to be embraced therein.

I claim:

1. In a self-cooling container for fluids, including a first chamber having walls for defining a fluid region interior thereto, a second chamber for containing a pressurizable refrigerant and having walls for defining a refrigerant region interior thereto, and means for causing a refrigerant in said second chamber to cool a fluid in said first chamber, the improvement comprising:

said first chamber including a substantially cylindrical recessed portion extending from a wall of said first chamber at least partially into said fluid region to a distal end having a substantially hemispherical shape, wherein the radius of the recessed portion is substantially constant, and wherein the radius of the hemispherically shaped distal end of the recessed portion is substantially equal to the radius of the recessed portion, and the outer wall of said second chamber being adapted to engage with and fit snugly within said recessed portion of said first chamber in a nested configuration, wherein the outer wall of said second chamber is substantially cylindrical and terminates in a distal end which is substantially hemispherical, wherein the radius of the outer wall of the second chamber is substantially constant, and wherein the radius of the hemispherical distal end is substantially equal to the radius of the outer wall of the second chamber.

2. A self-cooling container for fluids according to claim 1, wherein said means for causing a refrigerant in said second chamber to cool a fluid in said first chamber comprises a refrigerant dispersal assembly including means for defining a dispersal region adjacent the first and second chambers, and cooling activation means for selectively forming a fluidic path from said refrigerant region of said second chamber to said dispersal region, wherein said dispersal region is substantially closed and is vented to regions exterior to said container.

3. A self-cooling container for fluids according to claim 2, wherein said dispersal region includes a first portion adjacent to said refrigerant region and separated therefrom by a coupling portion of said walls of said refrigerant region, and a second portion adjacent to said fluid region and separated therefrom by a coupling portion of said walls of said fluid region, said dispersal region and said fluid region being thermally coupled through said coupling portion of said walls of said fluid region, and wherein said fluidic path from said refrigerant region of said first chamber to said dispersal region is established through said coupling portion of said walls of said refrigerant region.

4. A self-cooling container for fluids according to claim 3, wherein said second chamber further includes means for release of said pressurizable material into said dispersal region.

5. A self-cooling container for fluids according to claim 4, wherein said second chamber comprises a capsule having at least one port through which said pressurizable material can be introduced and released.

6. A self-cooling container for fluids according to claim 5, wherein said cooling activation means is selectively engageable with said second chamber within said refrigerant dispersal region, wherein engagement of said cooling activation means with the second chamber causes said port to be opened for release of said pressurizable material from said second chamber.

7. A self-cooling container for fluids according to claim 6, wherein said second chamber is refillable with a pressurizable material after said pressurizable material has been released therefrom.

8. A self-cooling container for fluids according to claim 7, wherein said recessed portion of said first chamber extends along a principal axis of said first chamber and said container.

9. A self-cooling container for fluids according to claim 1, wherein said second chamber and said recessed portion of said first chamber are of substantially the same size and shape, wherein the walls of said second chamber are nested in substantially contiguous relation within the walls of said recessed portion of said first chamber when said second chamber is engaged with said recessed portion of said first chamber.

10. A self-cooling container for fluids according to claim 8, wherein the walls of said second chamber and said recessed portion of said first chamber are sloped at a nominal angle θ from said principal axis to facilitate introduction and removal of said second chamber from said recessed portion of said first chamber.

11. A self-cooling container for fluids according to claim 10, wherein said nominal angle θ is at least approximately 1°.

12. A self-cooling container for fluids according to claim 9, wherein the region between the walls of said second chamber and said recessed portion of said first chamber is filled with a thermally conductive material.

13. In a self-cooling container for fluids, including a first chamber having walls for defining a fluid region interior thereto, a second chamber for containing a pressurizable material and having walls for defining a refrigerant region interior thereto, and a refrigerant dispersal assembly having means for defining a dispersal region adjacent the first and second chambers, said dispersal region including a first portion adjacent to said refrigerant region and separated therefrom by a coupling portion of said walls of said refrigerant region, and including a second portion adjacent to said fluid region and separated therefrom by a coupling portion of said walls of said fluid region, said dispersal region and said fluid region being thermally coupled through said coupling portion of said walls of said fluid region, said dispersal region being substantially closed and being vented to regions exterior to said container, and cooling activation means for selectively forming a fluidic path from said refrigerant region of said second chamber to said dispersal region through said coupling portion of said walls of said refrigerant region, the improvement comprising:

said first chamber including a substantially cylindrical recessed portion extending from a wall of said first chamber at least partially into said fluid region to a distal end having a substantially hemispherical shape at said distal end, wherein the radius of the recessed portion is substantially constant, and wherein the radius of the hemispherically shaped distal end of the recessed portion is substantially equal to the radius of the recessed portion, and the outer wall of said second chamber being adapted to engage with and fit snugly within said recessed portion of said first chamber in a nested configuration, wherein the outer wall of said second chamber is substantially cylindrical and terminates in a distal end which is substantially hemispherical, wherein the radius of the outer wall of the second chamber is substantially constant, and wherein the radius of the hemispherical distal end is substantially equal to the radius of the outer wall of the second chamber.

* * * * *